US006688993B2

(12) United States Patent
Sajima

(10) Patent No.: US 6,688,993 B2
(45) Date of Patent: Feb. 10, 2004

(54) GOLF BALL

(75) Inventor: Takahiro Sajima, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/167,582

(22) Filed: Jun. 13, 2002

(65) Prior Publication Data

US 2003/0008729 A1 Jan. 9, 2003

(30) Foreign Application Priority Data

Jun. 20, 2001 (JP) ..... 2001-185765

(51) Int. Cl.[7] ..... A63B 37/12; A63B 37/14; A63B 37/00

(52) U.S. Cl. ..... 473/378; 473/383; 473/351

(58) Field of Search ..... 473/378–385

(56) References Cited

U.S. PATENT DOCUMENTS

| | | | | |
|---|---|---|---|---|
| 4,681,323 A | | 7/1987 | Alaki et al. | |
| 4,765,626 A | * | 8/1988 | Gobush | 473/383 |
| 5,090,705 A | | 2/1992 | Oka et al. | |
| 5,145,180 A | * | 9/1992 | Oka | 473/382 |
| 5,192,078 A | * | 3/1993 | Woo | 473/379 |
| 5,301,951 A | * | 4/1994 | Morell | 473/383 |
| 5,709,618 A | * | 1/1998 | Hwang | 473/382 |
| 6,039,660 A | * | 3/2000 | Kasashima et al. | 473/378 |
| 6,053,820 A | * | 4/2000 | Kasashima et al. | 473/378 |
| 6,066,055 A | * | 5/2000 | Nishino | 473/384 |
| 6,234,917 B1 | * | 5/2001 | Asakura | 473/378 |
| 6,346,054 B1 | * | 2/2002 | Shimosaka et al. | 473/383 |
| 6,390,938 B1 | * | 5/2002 | Asakura et al. | 473/378 |
| 6,540,625 B2 | * | 4/2003 | Sajima | 473/383 |

FOREIGN PATENT DOCUMENTS

JP 62-176465 A 8/1987

* cited by examiner

*Primary Examiner*—Paul T. Sewell
*Assistant Examiner*—Alvin A. Hunter, Jr.
(74) *Attorney, Agent, or Firm*—Birch, Stewart, Kolasch & Birch, LLP

(57) ABSTRACT

A golf ball (1) has a dimple "A", a dimple "a", a dimple "B" and a dimple "b". The dimple "A" and the dimple "a" have diameters equal to each other, and the dimple "B" and the dimple "b" have diameters equal to each other. The volume of the dimple "A" is greater than that of the dimple "a". The volume of the dimple "B" is greater than that of the dimple "b". A ratio of the number of the dimples having the smaller volume V1 than the volume V2 to the total number of the dimples is 10% to 90%. The sum of the dimple volumes is 480 $mm^3$ to 620 $mm^3$. The golf ball (1) has an excellent flight performance.

5 Claims, 17 Drawing Sheets

GOLF BALL

BACKGROUND OF THE INVENTION

1. Field of the Invention

The present invention relates to a golf ball and more particularly to an improvement in a dimple of the golf ball.

2. Description of the Related Art

A golf ball has approximately 250 to 550 dimples on a surface thereof. The role of the dimples resides in one aspect that such dimples disturb an air flow around the golf ball during the flight of the golf ball to promote the transition of a turbulent flow on a boundary layer, thereby causing a turbulent flow separation (which will be hereinafter referred to as a "dimple effect"). The promotion of the transition of the turbulent flow causes a separating point of air from the golf ball to be shifted backwards so that a pressure resistance is reduced. Moreover, the promotion of the transition of the turbulent flow increases a difference between the upper and lower separating points of the golf ball which is caused by a backspin. Consequently, a lift acting on the golf ball is increased. A pressure resistance is reduced and the lift is enhanced so that the flight distance of the golf ball is increased. A dimple which easily promotes the transition of the turbulent flow, that is, a dimple capable of disturbing an air flow much better is aerodynamically excellent.

In order to obtain a golf ball having an excellent flight performance, there have been variously investigated a dimple volume (see Japanese Laid-Open Patent Publications Nos. 60-163674(U.S. Pat. No. 4,681,323) and 62-176465). At present, a large number of golf balls have the sum of dimple volumes (total volume) regulated to 480 $mm^3$ to 620 $mm^3$.

There has been variously investigated a surface area occupation ratio to be the ratio of a total area of dimples occupying the surface area of a virtual spherical surface (see Japanese Laid-Open Patent Publication No. 3-80876(U.S. Pat. No. 5,090,705)). At present, a large number of golf balls have the surface area occupation ratio regulated to 60% to 90%.

Furthermore, the planar and sectional shapes of the dimple, the number of dimples and an arrangement pattern have been variously improved in order to obtain a golf ball having an excellent flight performance.

The most important performance required for a golf ball by a golfer is a flight performance. The golf ball having an excellent flight performance gives a feeling of refreshing to the golfer, and furthermore, a score in a golf game can also be enhanced. While various improvements have been made for the dimple as described above, the golfer desires amore enhancement in the flight distance under actual circumstances.

SUMMARY OF THE INVENTION

The present invention has been made in consideration of such actual circumstances and has an object to provide a golf ball which has dimples improved and is therefore excellent in a flight performance.

In order to attain the object, the present invention provides a golf ball having a large number of dimples on a surface, wherein when a volume of a region surrounded by a plane including edges of the dimples and surfaces of the dimples is represented by V1 and a volume of a region surrounded by the plane including the edges of the dimples and a virtual spherical surface is represented by V2, a ratio of the number of the dimples having the smaller volume V1 than the volume V2 to the total number of the dimples is 10% to 90%, and a sum of the dimple volumes obtained by adding the volumes V1 and the volumes V2 is 480 $mm^3$ to 620 $mm^3$.

An ordinary golf ball employs a dimple having the greater volume V1 than the volume V2. On the other hand, the golf ball according to the present invention includes the dimple having the smaller volume V1 than the volume V2. The dimple having the smaller V1 than the volume V2 gives a small dimple volume for an area. The surface area of a virtual spherical surface is limited. Therefore, the golf ball including a dimple having the smaller volume V1 than the volume V2 and having a proper total dimple volume necessarily includes a dimple having the greater volume V1 than the volume V2 or both of them equal to each other. More specifically, the golf ball according to the present invention has both a dimple satisfying ($V1<V2$) and a dimple satisfying ($V1 \geqq V2$). In the golf ball, the dimple satisfying ($V1<V2$) and a dimple satisfying ($V1 \geqq V2$) appear in mixture by a backspin. Consequently, the effect of disturbing an air flow can be promoted. The golf ball has an excellent flight performance.

Preferably, a ratio ($V2/V1$) of the volume V2 to the volume V1 in the dimple having the smaller volume V1 than the volume V2 is 1.01 or more. Consequently, the effect of disturbing an air flow can be promoted still more.

Preferably, the golf ball includes a dimple having the smaller volume V1 than the volume V2 and a diameter of 3.8 mm or more. The dimple having a comparatively large diameter and satisfying ($V1<V2$) can promote the disturbance of the air flow still more. A ratio of the number of the dimples having the smaller volume V1 than the volume V2 and a diameter of 3.8 mm or more to the total number of the dimples is preferably 10% to 45%.

Preferably, the golf ball includes plural kinds of dimples having diameters different from each other and the smaller volume V1 than the volume V2. Consequently, the disturbance of the air flow can be promoted still more.

In the golf ball having a surface area occupation ratio of 60% to 90%, the effect of enhancing a flight performance by the mixture of the dimple satisfying ($V1<V2$) and the dimple satisfying ($V1 \geqq V2$) is particularly remarkable.

DESCRIPTION OF THE PREFERRED EMBODIMENTS

The present invention will be described below in detail based on a preferred embodiment with reference to the drawings.

Figure 1:
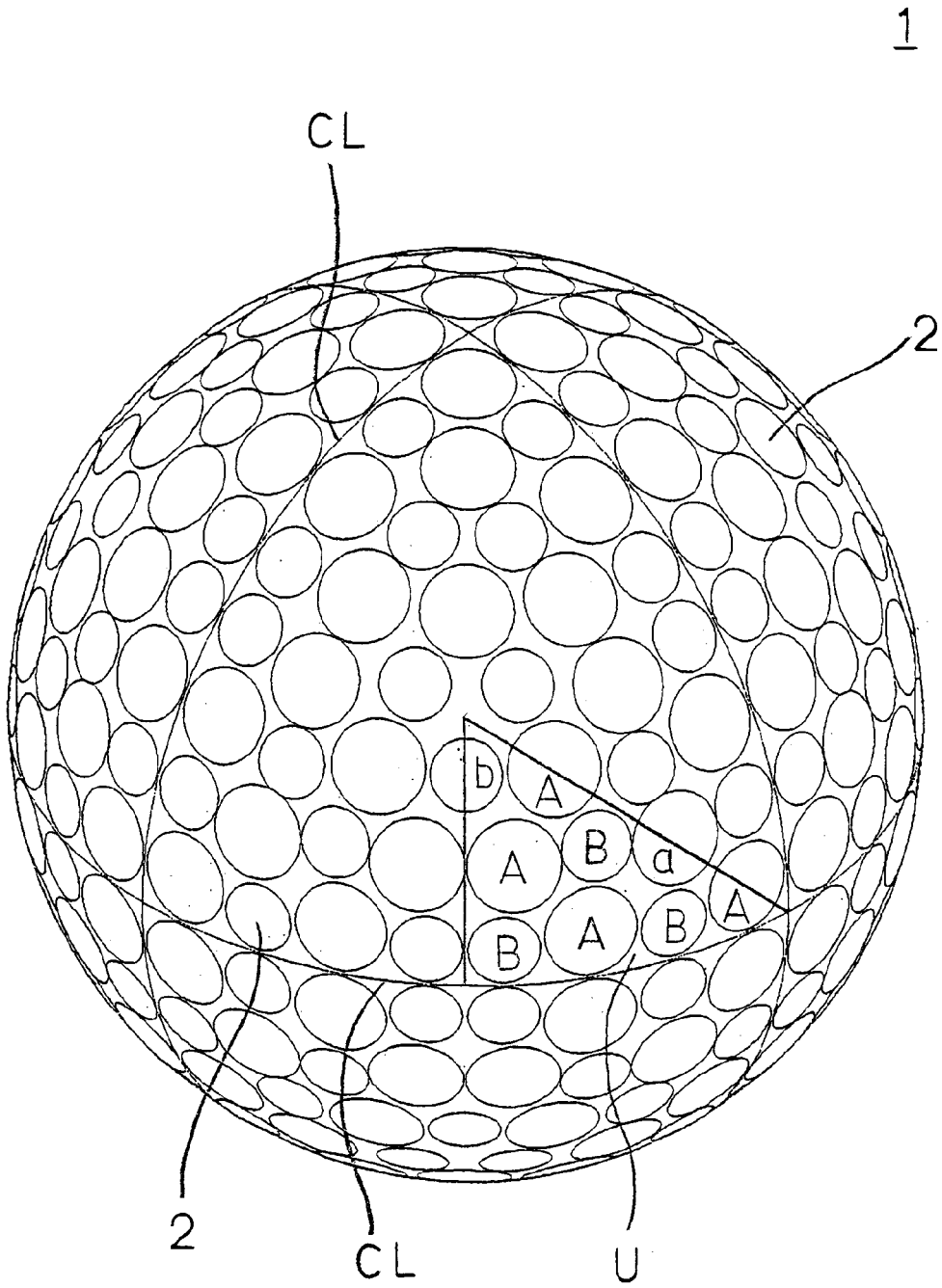
FIG. 1 is a front view showing a golf ball according to an embodiment of the present invention.

A golf ball 1 shown in FIG. 1 has 336 dimples 2 on a surface. All the dimples 2 are circular dimples. More specifically, a shape of the dimple 2 seen in the direction of a normal is a circle. The golf ball 1 usually has a diameter of approximately 42.67 mm to 43.00 mm, particularly, approximately 42.67 mm to 42.80 mm.

The golf ball 1 has a regular octahedron dimple pattern. More specifically, a regular octahedron inscribed in a virtual spherical surface is assumed and the virtual spherical surface is comparted into eight spherical regular triangles by 12 comparting lines CL on which 12 sides of the regular octahedron are projected so that the dimple 2 is arranged for each spherical regular triangle. In this example, dimple patterns in all the spherical regular triangles are identical. As a matter of course, the dimple pattern may be varied for each spherical regular triangle. Moreover, the dimple 2 may be arranged by a method other than a method using the regular octahedron. For convenience of description, the comparting line CL is described in FIG. 1. In an actual golf ball, the comparting line CL is not recognized as an edge.

The golf ball 1 has four kinds of dimples 2 indicated as A, a, B and b in FIG. 1. The dimples "A" and "a" have diameters equal to each other and volumes different from each other. The volume of the dimple "A" is greater than that of the dimple "a". The dimples "B" and "b" have diameters equal to each other and volumes different from each other. The volume of the dimple "B" is greater than that of the dimple "b". In FIG. 1, the type of the dimples 2 is illustrated in one unit U obtained by further dividing the spherical regular triangle into six portions. The dimple pattern of the whole golf ball is obtained by continuously repeating the dimple pattern of the unit U.

Figure 2:
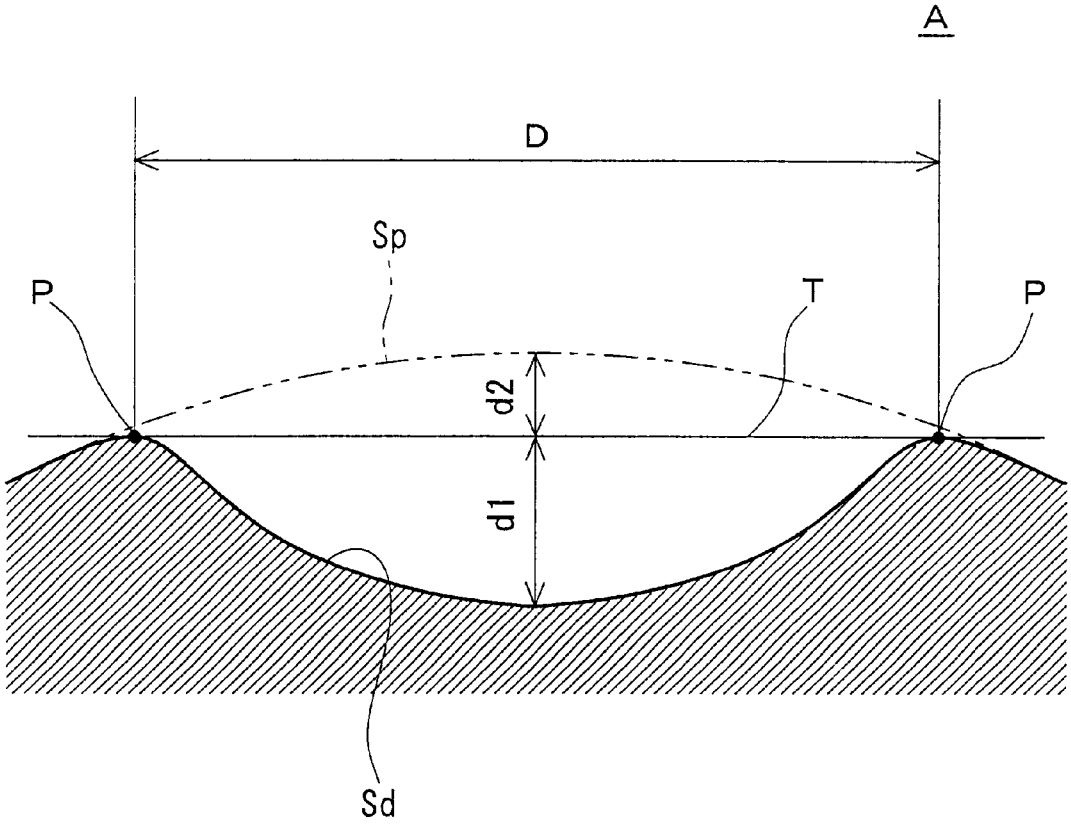
FIG. 2 is an enlarged sectional view showing a part of the golf ball in FIG. 1.

FIG. 2 is an enlarged sectional view showing a part of the golf ball 1 in FIG. 1. In FIG. 2, the vicinity of the dimple "A" is shown. A dimple surface Sd is concaved from a virtual spherical surface Sp. In FIG. 2, the designation T denotes a straight line tangenting to both sides of the dimple 2. A tangent point P is positioned on a dimple edge (the contour of the dimple 2). A distance between both tangent points P and P is a diameter D of the dimple 2. In FIG. 2, a plane perpendicular to a paper and including the straight line T contains the dimple edge.

A distance between the deepest portion of the dimple surface Sd and the plane including the dimple edge is represented by a depth d1. Moreover, a distance between the most distant portion from the plane including the dimple edge in the virtual spherical surface Sp and the plane including the dimple edge is represented by a depth d2. In the dimple "A" shown in FIG. 2, the depth d1 is greater than the depth d2. The sum of the depth d1 and the depth d2 represents a total depth d. A region surrounded by the plane including the dimple edge and the dimple surface Sd has a volume V1. A region surrounded by the plane including the dimple edge and the virtual spherical surface Sp has a volume V2.

Figure 3:
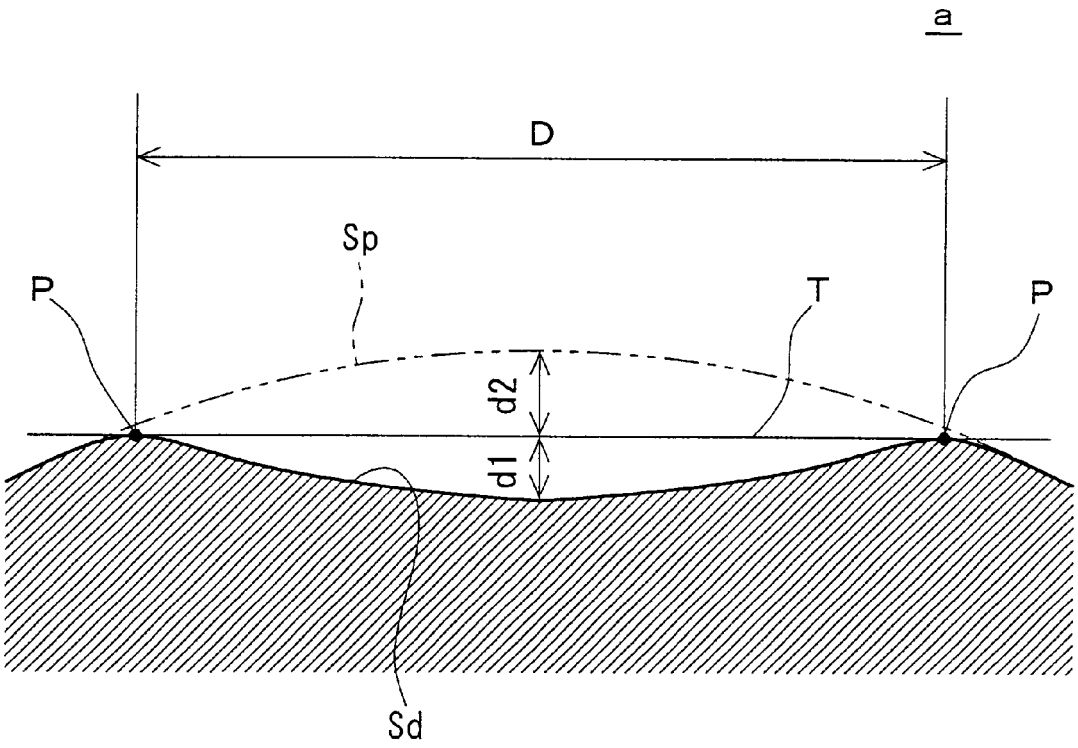
FIG. 3 is an enlarged sectional view showing another part of the golf ball in FIG. 1.

FIG. 3 is an enlarged sectional view showing another part of the golf ball 1 in FIG. 1. In FIG. 3, the vicinity of the dimple "a" is illustrated. The definition of the straight line T, the tangent point P, the dimple diameter D, the depth d1, the depth d2, the total depth d, the volume V1 and the volume V2 is the same as that in the case of the dimple "A" shown in FIG. 2. In the dimple "a" shown in FIG. 3, the depth d1 is smaller than the depth d2.

The dimples "A" and "a" having the diameters D equal to each other are different from each other in that ($V1 \geqq V2$) is satisfied in the dimple "A" and ($V1 < V2$) is satisfied in the dimple "a". The dimples "B" and "b" having the diameters D equal to each other are different from each other in that ($V1 \geqq V2$) is satisfied in the dimple "B" and ($V1 < V2$) is satisfied in the dimple "b", of which section is not shown.

A ratio of the number of dimples in which the volume V1 is smaller than the volume V2 (the sum of the number of the dimples "a" and that of the dimples "b") to the total number of the dimples (the sum of the number of the dimples "A", that of the dimples "a", that of the dimples "B" and that of the dimples "b") is set to 10% to 90%. More specifically, the golf ball 1 has both the dimple 2 satisfying ($V1 < V2$) and the dimple 2 satisfying ($V1 \geqq V2$). By the mixture, an air flow is disturbed during the flight of the golf ball so that the transition of a turbulent flow on the boundary layer is promoted. In consideration of the promotion of the transition of the turbulent flow by the mixture, the ratio is preferably 15% to 85%, more preferably 22% to 70%, and most preferably 35% to 65%.

In the dimple in which the volume V1 is smaller than the volume V2, a ratio (V2/V1) of the volume V1 to the volume V2 is preferably 1.01 or more. If the ratio (V2/V1) is less than 1.01, the transition of the turbulent flow is promoted insufficiently in some cases. From this viewpoint, a ratio (V2/V1) of 1.05 or more is particularly preferable. If the ratio (V2/V1) is too high, a total volume which will be described below in detail becomes insufficient because of the limited surface area of the virtual spherical surface Sp. In this respect, the ratio (V2/V1) is preferably 2.00 or less and more preferably 1.5 or less.

The volume Vt of each dimple 2 is calculated by adding the volume V1 and the volume V2. The sum of the volumes Vt of all the dimples 2 (which will be hereinafter referred to as a "total volume") is set to 480 $mm^3$ to 620 $mm^3$. If the total volume is less than 480 $mm^3$, the trajectory of the golf ball 1 is too increased so that a flight distance becomes insufficient. In this respect, the total volume is more preferably 490 $mm^3$ or more and most preferably 500 $mm^3$ or more. If the total volume is more than 620 mm, the trajectory of the golf ball 1 is too reduced so that the flight distance becomes insufficient. In this respect, the total volume is more preferably 610 $mm^3$ or less and most preferably 600 $mm^3$ or less.

The diameter of the dimple 2 is usually set to 2.0 mm to 7.0 mm. If the diameter is less than the range described above, the dimple effect becomes insufficient in some cases. In this respect, the diameter is more preferably 2.5 mm or more and most preferably 3.0 mm or more. If the diameter exceeds the range described above, the golf ball 1 is deformed so that an appearance is deteriorated, and furthermore, the golf ball 1 might be rolled rectilinearly with difficulty. In this respect, the diameter is more preferably 6.5 mm or less and most preferably 6.0 mm or less.

The dimple 2 satisfying (V1<V2) and having a diameter of 3.8 mm or more (the dimple having a comparatively large diameter) produces a great effect of disturbing an air flow. If the ratio of the number of such dimples to that of all the dimples is 10% or more, the transition of the turbulent flow is promoted. In this respect, the ratio is more preferably 12% or more and most preferably 14% or more. If the ratio is too high, the degree of freedom of a dimple pattern is restricted so that a surface area occupation ratio is reduced. Therefore, the ratio is preferably 45% or less, more preferably 43% or less and most preferably 41% or less.

In the golf ball 1 shown in FIG. 1, the diameter of the dimple "a" and that of the dimple "b" are different from each other and have the volume V1 smaller than the volume V2. Thus, plural kinds (in this example, two kinds) of dimples 2 satisfying (V1<V2) are formed so that the transition of the turbulent flow is promoted. In respect of the promotion of the transition of the turbulent flow, it is preferable to form plural kinds of dimples in which the ratio of the number of the dimples to that of all the dimples is 5% or more, particularly, 10% or more and (V1<V2) is satisfied.

It is preferable that the surface area occupation ratio should be 60% to 90%. If the surface area occupation ratio is less than the range described above, the flight performance of the golf ball 1 becomes insufficient in some cases. In this respect, the surface area occupation ratio is more preferably 65% or more, and most preferably, 68% or more. If the surface area occupation ratio exceeds 90%, the trajectory is apt to be high. In this respect, the surface area occupation ratio is more preferably 85% or less, and most preferably, 82% or less.

If the dimple satisfying (V1<V2) (the dimples "a" and "b" in FIG. 1) and the dimple satisfying (V1≧V2) (the dimples "A" and "B" in FIG. 1) are adjacent to each other, both of them appear alternately by a backspin. Therefore, the air flow is disturbed more easily. 50% or more, furthermore 65% or more and particularly 75% or more of the dimples satisfying (V1<V2) are adjacent to the dimples satisfying (V1≧V2) so that the transition of the turbulent flow is more promoted. The adjacency of the dimples implies that the arc of a great circle connecting the centers of both dimples does not intersect with other dimples 2.

While the golf ball 1 shown in FIG. 1 has only circular dimples, a non-circular dimple may be formed in place of the circular dimple or together with the circular dimple. The edge of the non-circular dimple is not present on a plane. Therefore, the volume V1 and the volume V2 cannot be calculated strictly. In the non-circular dimple, a circle having the same area as that of the planar shape (the contour shape of the dimple seen in the direction of a normal) is assumed and a circular dimple having the same circle for a planar shape is assumed. The volume of a region surrounded by a plane including the edge of the assumed circular dimple and the virtual spherical surface is set to be the volume V2 of the non-circular dimple for convenience. Moreover, a value obtained by decreasing the volume V2 from the volume of the region surrounded by the virtual spherical surface and the surface of the non-circular dimple is set to be the volume V1 for convenience.

It is preferable that the total number of the dimples 2 should be 250 to 550. If the total number is less than the range described above, it might be hard to set the shape of the golf ball 1 to be almost spherical while maintaining a predetermined surface area occupation ratio (in other words, the smoothness of the surface of the golf ball 1 might be damaged). In this respect, it is particularly preferable that the total number should be 300 or more. If the total number exceeds the range described above, there is a possibility that the size of each dimple 2 might be reduced to produce the insufficient effect of disturbing the air flow. In this respect, it is particularly preferable that the total number should be 450 or less.

EXAMPLES

Example 1

An ionomer resin composition was injected around a core formed of solid rubber comprising polybutadiene as a base material, thereby forming a cover. Furthermore, the cover was subjected to painting. Thus, a golf ball according to an example 1 having the dimple pattern shown in FIG. 1 was obtained. The golf ball includes 144 dimples "A" having a diameter of 4.600 mm, a volume V1 of 1.228 $mm^3$, a volume V2 of 1.033 $mm^3$ and (V2/V1) of 0.842, 24 dimples "a" having a diameter of 4.600 mm, a volume V1 of 0.959 $mm^3$, a volume V2 of 1.033 $mm^3$ and (V2/V1) of 1.078, 144 dimples "B" having a diameter of 3.500 mm, a volume V1 of 0.464 $mm^3$, a volume V2 of 0.346 $mm^3$ and (V2/V1) of 0.536, and 24 dimples "b" having a diameter of 3.500 mm, a volume V1 of 0.321 $mm^3$, a volume V2 of 0.346 $mm^3$ and (V2/V1) of 1.078. In the golf ball, the total number of the dimples is 336 and a surface area occupation ratio is 77.0%, the total volume of the dimples is 532.2 $mm^3$, a ratio of the number of the dimples satisfying (V1<V2) to the total number of the dimples is 14.3%, and a ratio of the number of the dimples satisfying (V1<V2) and having a diameter of 3.8 mm or more to the total number of the dimples is 7.1%. Each dimple has a circular arc-shaped section. The golf ball has an outside diameter of 42.70 mm and has a PGA type compression of 85.

Examples 2 to 12 and Comparative Examples 1 to 5

A golf ball according to each of examples 2 to 12 and comparative examples 1 to 5 was obtained in the same manner as in the example 1 except that a metal mold was changed and a dimple specification shown in the following Tables 1 and 2 was used.

TABLE 1

| | | Dimple specificasion | | | | | | |
|---|---|---|---|---|---|---|---|---|
| | | Number | Diameter D (mm) | Depth d1 (mm) | Volume V1 ($mm^3$) | Depth d2 (mm) | Volme V2 ($mm^3$) | V2/V1 |
| Example 1 | A | 144 | 4.600 | 0.1475 | 1.228 | 0.1242 | 1.033 | 0.842 |
| | a | 24 | 4.600 | 0.1153 | 0.959 | 0.1242 | 1.033 | 1.078 |
| | B | 144 | 3.500 | 0.1339 | 0.646 | 0.0718 | 0.346 | 0.536 |
| | b | 24 | 3.500 | 0.0667 | 0.321 | 0.0718 | 0.346 | 1.078 |
| Example 2 | A | 120 | 4.600 | 0.1518 | 1.263 | 0.1242 | 1.033 | 0.818 |
| | a | 48 | 4.600 | 0.1153 | 0.959 | 0.1242 | 1.033 | 1.078 |
| | B | 144 | 3.500 | 0.1369 | 0.660 | 0.0718 | 0.346 | 0.524 |
| | b | 24 | 3.500 | 0.0667 | 0.321 | 0.0718 | 0.346 | 1.078 |
| Example 3 | A | 120 | 4.600 | 0.1563 | 1.301 | 0.1242 | 1.033 | 0.794 |
| | a | 48 | 4.600 | 0.1153 | 0.959 | 0.1242 | 1.033 | 1.078 |
| | B | 120 | 3.500 | 0.1434 | 0.691 | 0.0718 | 0.346 | 0.500 |
| | b | 48 | 3.500 | 0.0667 | 0.321 | 0.0718 | 0.346 | 1.078 |
| Example 4 | A | 96 | 4.600 | 0.1587 | 1.320 | 0.1242 | 1.033 | 0.783 |
| | a | 72 | 4.600 | 0.1153 | 0.959 | 0.1242 | 1.033 | 1.078 |
| | B | 120 | 3.500 | 0.1543 | 0.744 | 0.0718 | 0.346 | 0.465 |
| | b | 48 | 3.500 | 0.0667 | 0.321 | 0.0718 | 0.346 | 1.078 |
| Example 5 | A | 24 | 4.600 | 0.1688 | 1.406 | 0.1242 | 1.033 | 0.735 |
| | a | 144 | 4.600 | 0.1153 | 0.959 | 0.1242 | 1.033 | 1.078 |
| | B | 168 | 3.500 | 0.1583 | 0.764 | 0.0718 | 0.346 | 0.453 |
| | b | 0 | — | — | — | — | — | — |
| Example 6 | A | 96 | 4.600 | 0.1662 | 1.383 | 0.1242 | 1.033 | 0.747 |
| | a | 72 | 4.600 | 0.1153 | 0.959 | 0.1242 | 1.033 | 1.078 |
| | B | 96 | 3.500 | 0.1626 | 0.784 | 0.0718 | 0.346 | 0.441 |
| | b | 72 | 3.500 | 0.0667 | 0.321 | 0.0718 | 0.346 | 1.078 |
| Example 7 | A | 144 | 4.600 | 0.1862 | 1.550 | 0.1242 | 1.033 | 0.667 |
| | a | 24 | 4.600 | 0.1153 | 0.959 | 0.1242 | 1.033 | 1.078 |
| | B | 0 | — | — | — | — | — | — |
| | b | 168 | 3.500 | 0.0667 | 0.321 | 0.0718 | 0.346 | 1.078 |
| Example 8 | A | 72 | 4.600 | 0.1836 | 1.529 | 0.1242 | 1.033 | 0.676 |
| | a | 96 | 4.600 | 0.1153 | 0.959 | 0.1242 | 1.033 | 1.078 |
| | B | 72 | 3.500 | 0.1938 | 0.936 | 0.0718 | 0.346 | 0.369 |
| | b | 96 | 3.500 | 0.0667 | 0.321 | 0.0718 | 0.346 | 1.078 |
| Example 9 | A | 0 | — | — | — | — | — | — |
| | a | 168 | 4.600 | 0.1153 | 0.959 | 0.1242 | 1.033 | 1.078 |
| | B | 144 | 3.500 | 0.1889 | 0.912 | 0.0718 | 0.346 | 0.379 |
| | b | 24 | 3.500 | 0.0667 | 0.321 | 0.0718 | 0.346 | 1.078 |

TABLE 2

| | | Dimple specificasion | | | | | | |
|---|---|---|---|---|---|---|---|---|
| | | Number | Diameter d (mm) | Depth d1 (mm) | Volume V1 ($mm^3$) | Depth d2 (mm) | Volume V2 ($mm^3$) | V2/V1 |
| Example 10 | A | 48 | 4.600 | 0.2059 | 1.715 | 0.1242 | 1.033 | 0.602 |
| | a | 120 | 4.600 | 0.1153 | 0.959 | 0.1242 | 1.033 | 1.078 |
| | B | 72 | 3.500 | 0.2070 | 1.001 | 0.0718 | 0.346 | 0.346 |
| | b | 96 | 3.500 | 0.0667 | 0.321 | 0.0718 | 0.346 | 1.078 |
| Example 11 | A | 48 | 4.600 | 0.2323 | 1.937 | 0.1242 | 1.033 | 0.533 |
| | a | 120 | 4.600 | 0.1153 | 0.959 | 0.1242 | 1.033 | 1.078 |
| | B | 48 | 3.500 | 0.2308 | 1.117 | 0.0718 | 0.346 | 0.310 |
| | b | 120 | 3.500 | 0.0667 | 0.321 | 0.0718 | 0.346 | 1.078 |
| Example 12 | A | 24 | 4.600 | 0.3665 | 3.071 | 0.1242 | 1.033 | 0.336 |
| | a | 144 | 4.600 | 0.1153 | 0.959 | 0.1242 | 1.033 | 1.078 |
| | B | 24 | 3.500 | 0.3630 | 1.771 | 0.0718 | 0.346 | 0.195 |
| | b | 144 | 3.500 | 0.0667 | 0.321 | 0.0718 | 0.346 | 1.078 |
| Com. | A | 168 | 4.600 | 0.1397 | 1.162 | 0.1242 | 1.033 | 0.889 |
| example 1 | a | 0 | — | — | — | — | — | — |
| | B | 168 | 3.500 | 0.1294 | 0.624 | 0.0718 | 0.346 | 0.555 |
| | b | 0 | — | — | — | — | — | — |
| Com. | A | 144 | 4.600 | 0.1386 | 1.153 | 0.1242 | 1.033 | 0.896 |
| example 2 | a | 24 | 4.600 | 0.1153 | 0.959 | 0.1242 | 1.033 | 1.078 |
| | B | 168 | 3.500 | 0.1369 | 0.660 | 0.0718 | 0.346 | 0.524 |
| | b | 0 | — | — | — | — | — | — |

TABLE 2-continued

| | | Dimple specificasion | | | | | | |
|---|---|---|---|---|---|---|---|---|
| | | Number | Diameter d (mm) | Depth d1 (mm) | Volume V1 ($mm^3$) | Depth d2 (mm) | Volume V2 ($mm^3$) | V2/V1 |
| Com. example 3 | A | 24 | 4.600 | 0.5340 | 4.517 | 0.1242 | 1.033 | 0.229 |
| | a | 144 | 4.600 | 0.1153 | 0.959 | 0.1242 | 1.033 | 1.078 |
| | B | 0 | — | — | — | — | — | — |
| | b | 168 | 3.500 | 0.0667 | 0.321 | 0.0718 | 0.346 | 1.078 |
| Com. example 4 | A | 96 | 4.600 | 0.1294 | 1.077 | 0.1242 | 1.033 | 0.960 |
| | a | 72 | 4.600 | 0.1153 | 0.959 | 0.1242 | 1.033 | 1.078 |
| | B | 96 | 3.500 | 0.0877 | 0.422 | 0.0718 | 0.346 | 0.819 |
| | b | 72 | 3.500 | 0.0667 | 0.321 | 0.0718 | 0.346 | 1.078 |
| Com. example 5 | A | 96 | 4.600 | 0.2431 | 2.028 | 0.1242 | 1.033 | 0.510 |
| | a | 72 | 4.600 | 0.1153 | 0.959 | 0.1242 | 1.033 | 1.078 |
| | B | 96 | 3.500 | 0.2400 | 1.162 | 0.0718 | 0.346 | 0.298 |
| | b | 72 | 3.500 | 0.0667 | 0.321 | 0.0718 | 0.346 | 1.078 |

[Flight Distance Test]

20 golf balls according to each of the examples and the comparative examples were prepared, respectively. On the other hand, a driver (W1) formed of a metal head was attached to a swing machine manufactured by True Temper Co., and machine conditions were adjusted to set a head speed of approximately 49 m/s, a launch angle of approximately 11 degrees and a backspin rotation speed of approximately 3000 rpm. The golf ball was hit and a carry (a distance from a launch point to a fall point) and a total flight distance (a distance from the launch point to a stop point) were measured. A mean value obtained as a result of the measurement is shown in the following Tables 3 and 4. It rarely blew during the test.

TABLE 3

Figure 4:
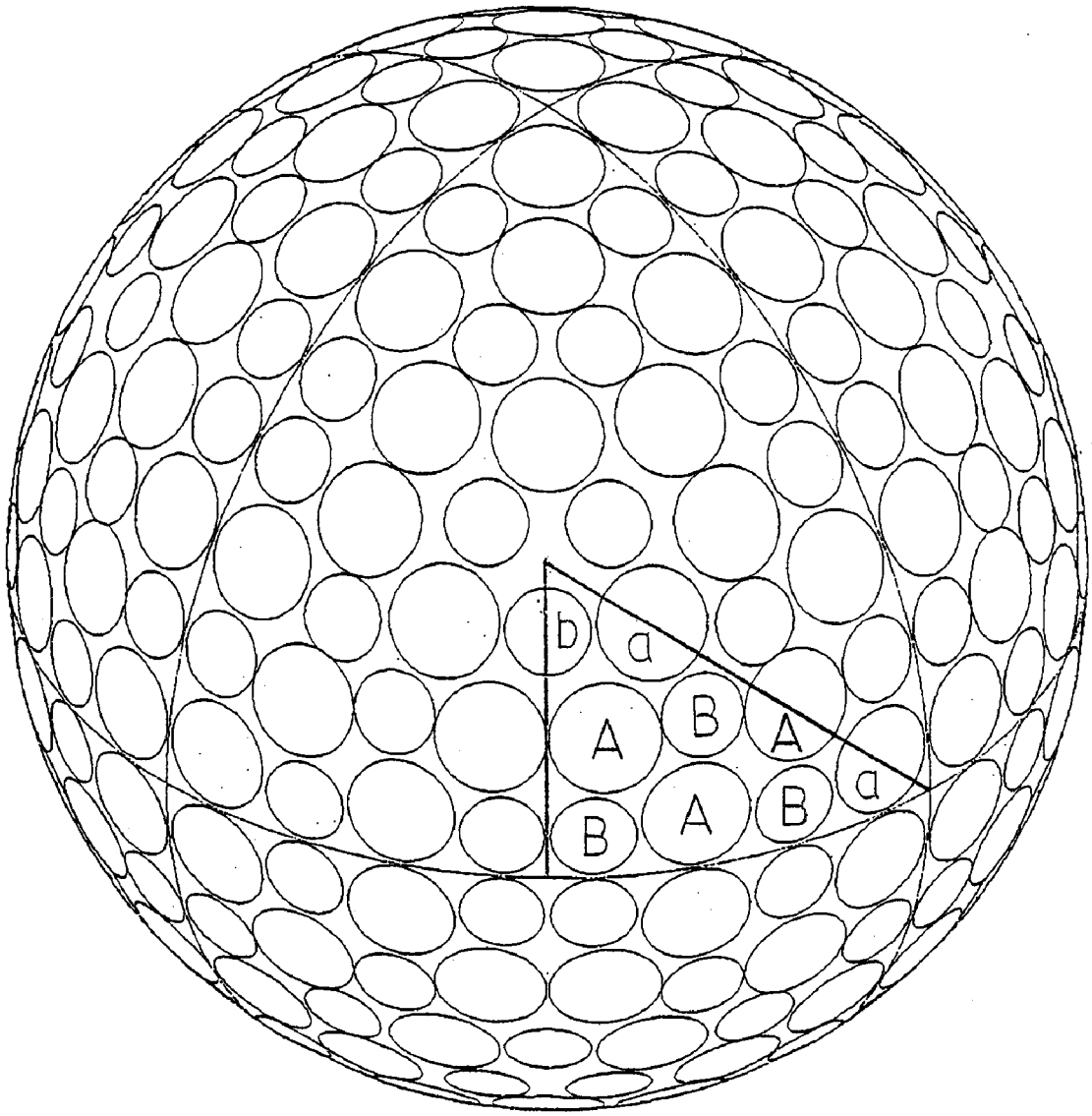
FIG. 4 is a front view showing a golf ball according to an example 2 of the present invention.
Figure 5:
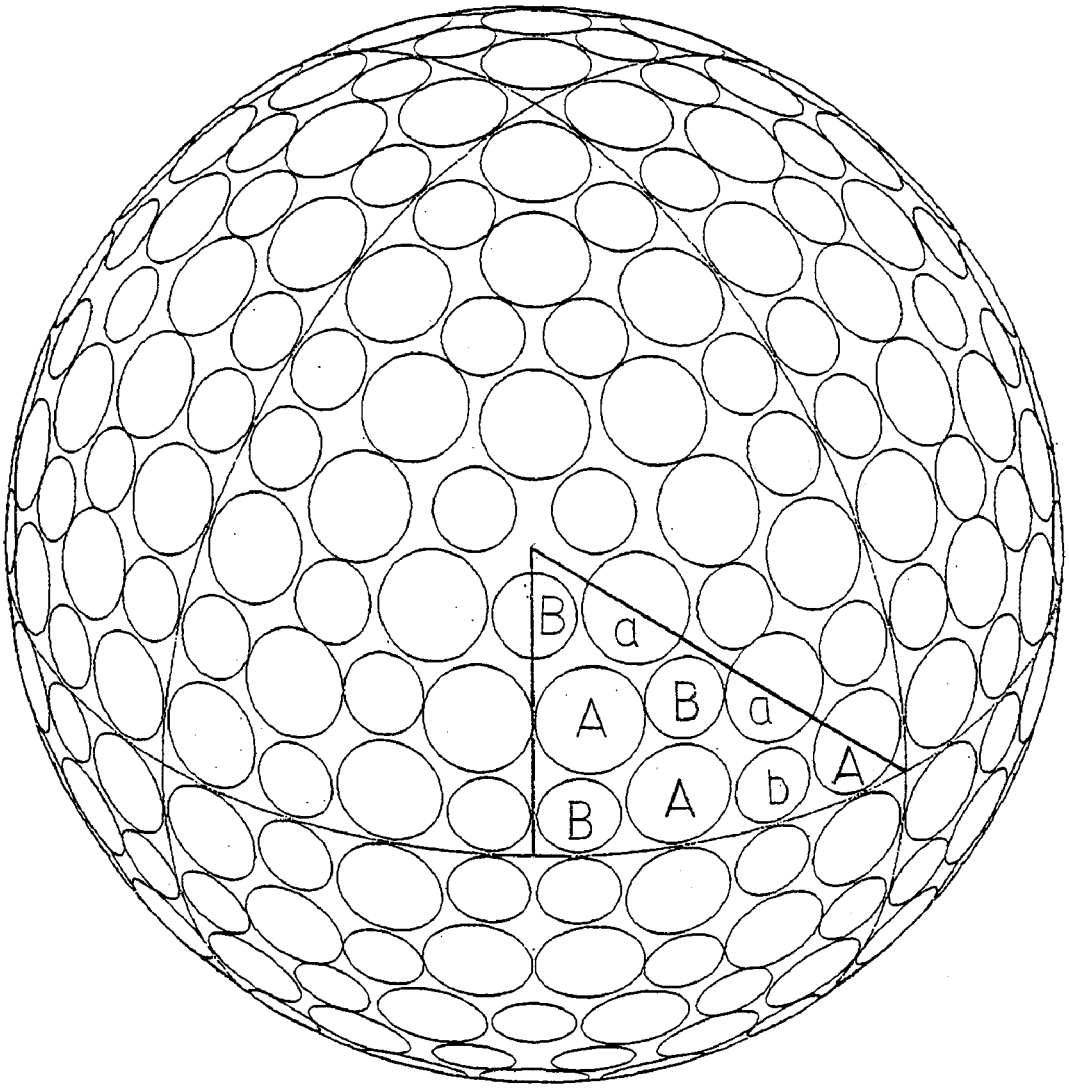
FIG. 5 is a front view showing a golf ball according to an example 3 of the present invention.
Figure 6:
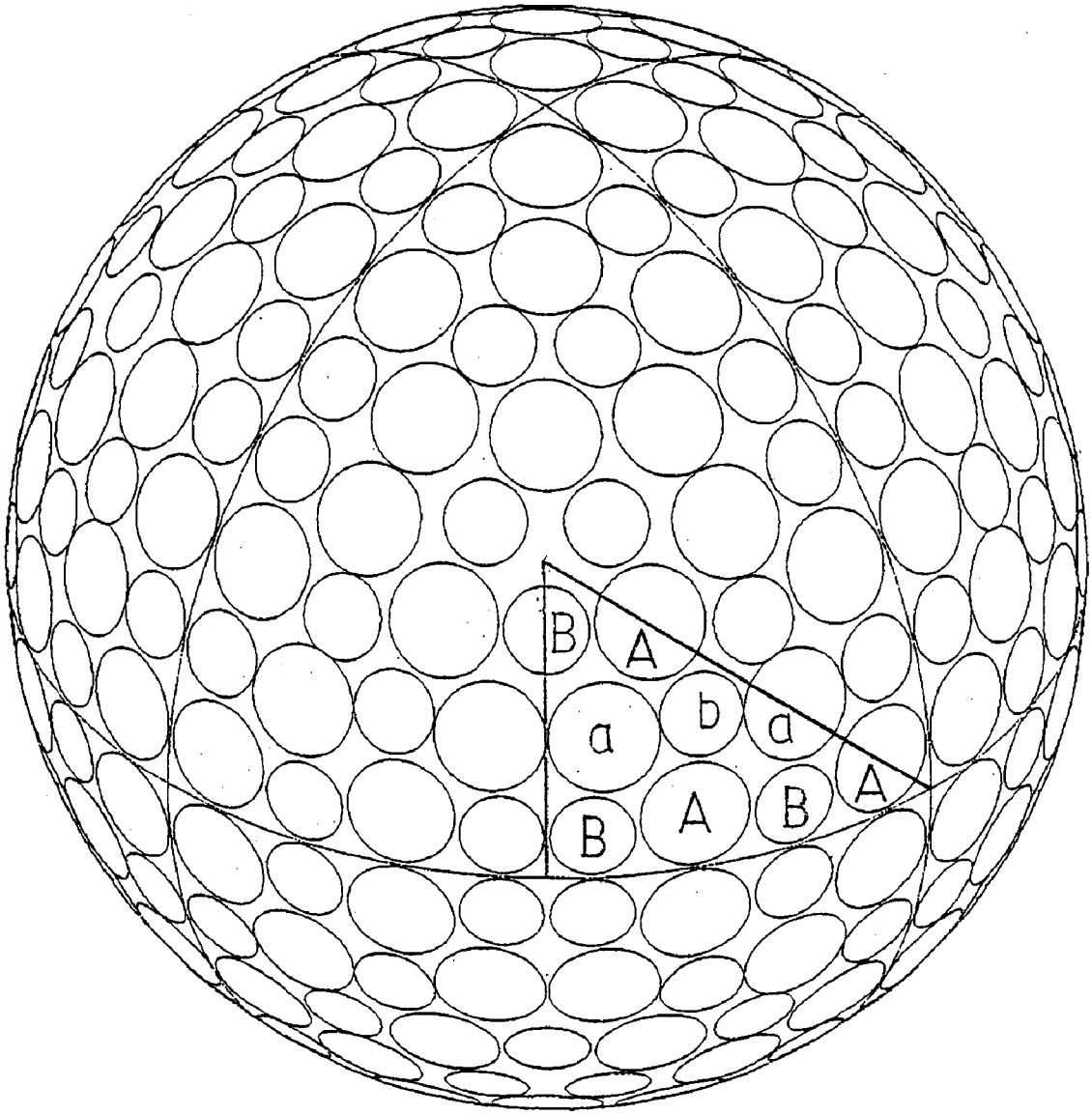
FIG. 6 is a front view showing a golf ball according to an example 4 of the present invention.
Figure 7:
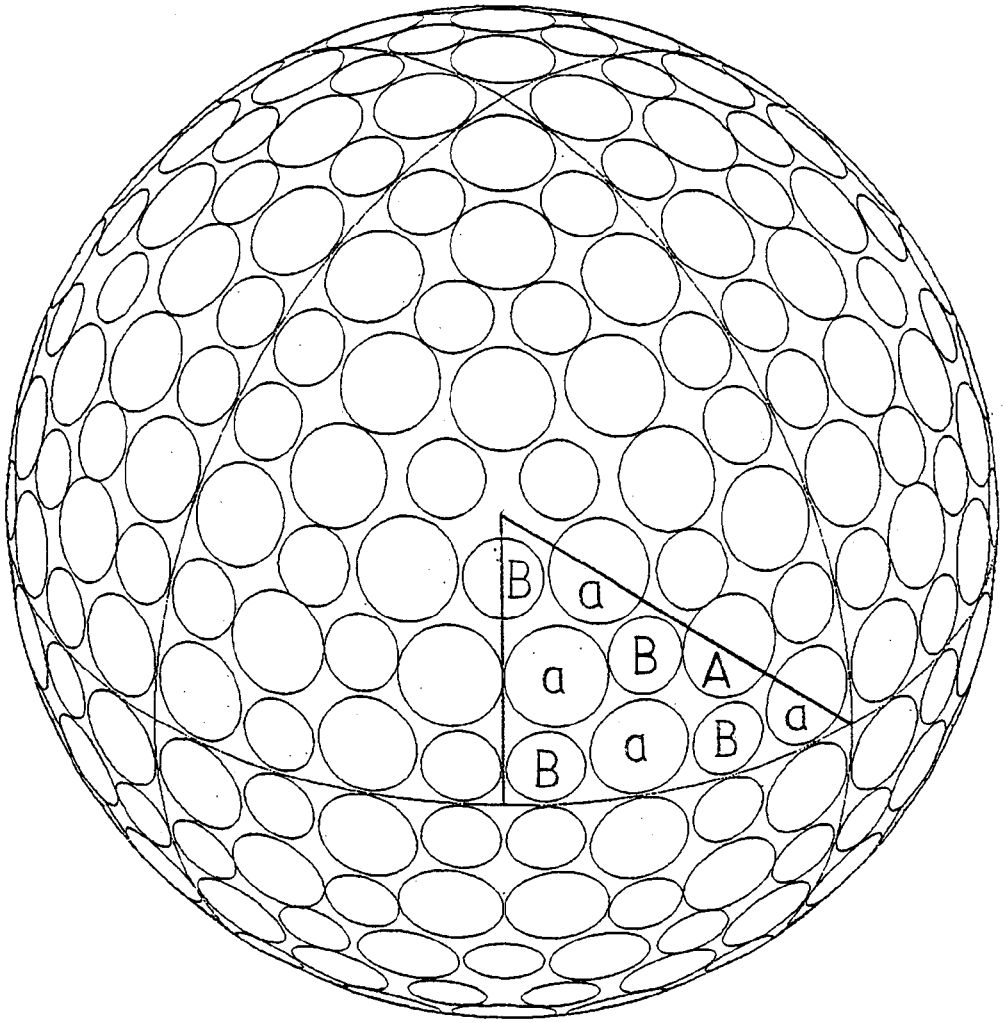
FIG. 7 is a front view showing a golf ball according to an example 5 of the present invention.
Figure 8:
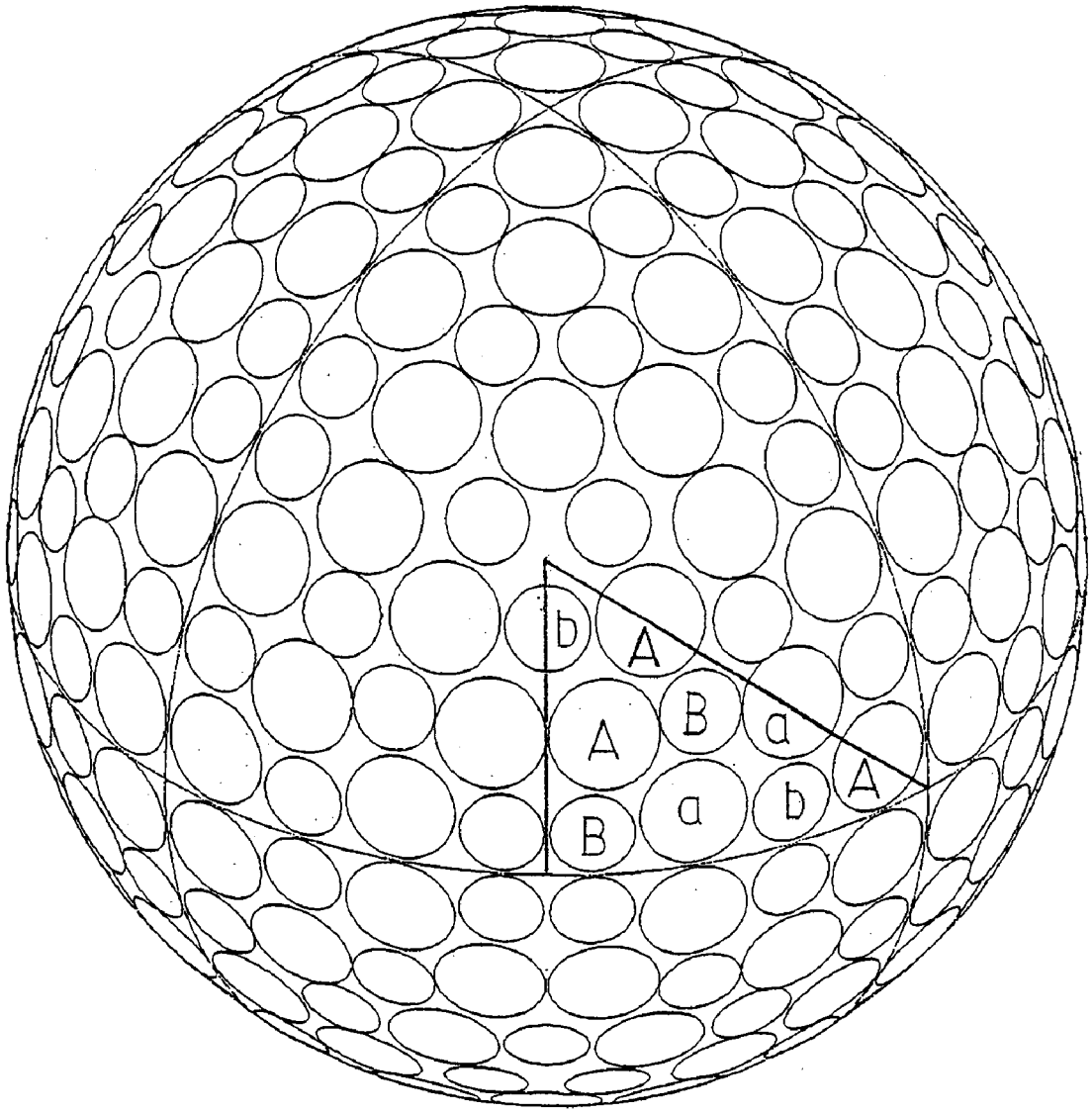
FIG. 8 is a front view showing a golf ball according to each of an example 6 and comparative examples 4 and 5 of the present invention.
Figure 9:
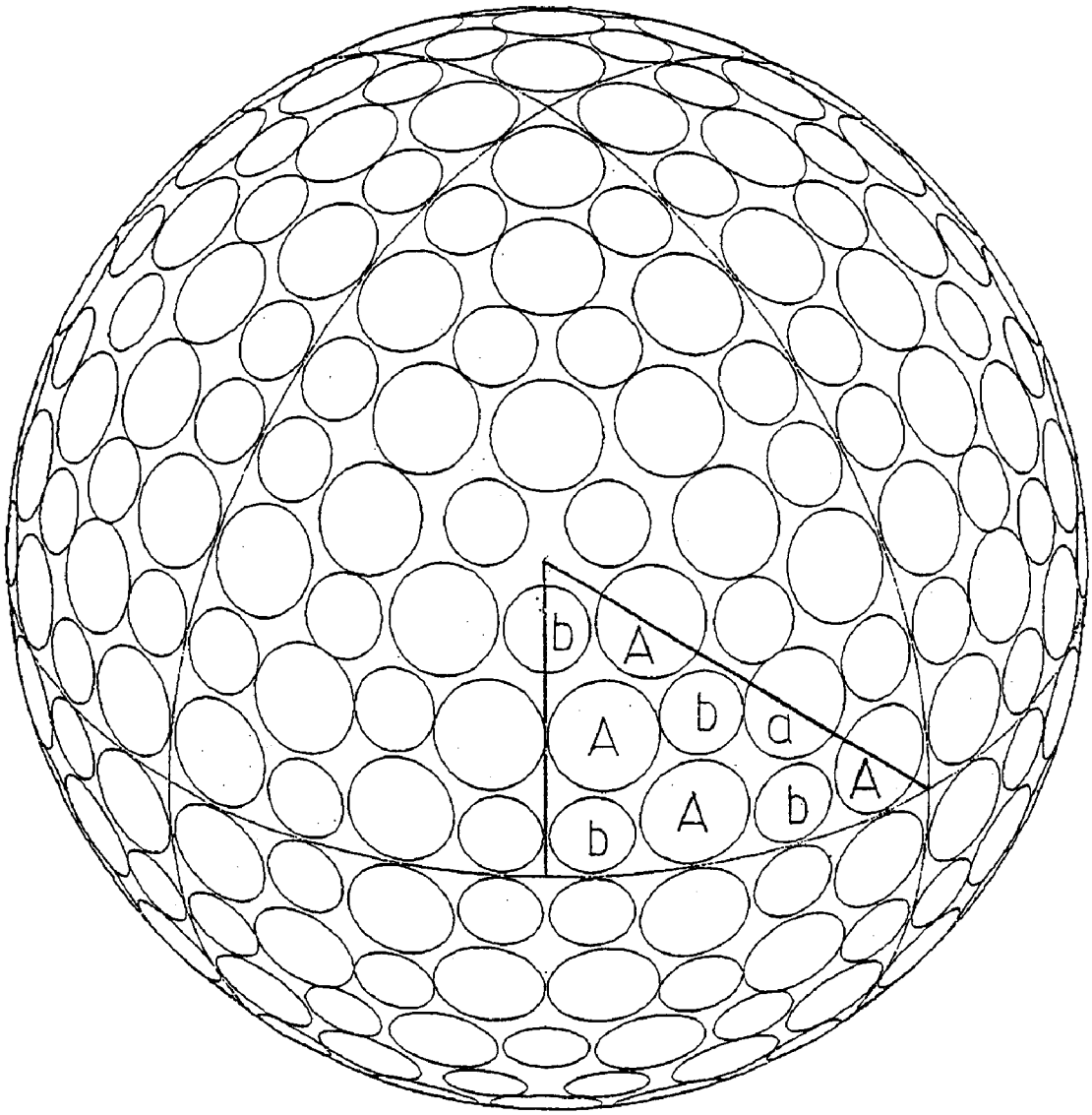
FIG. 9 is a front view showing a golf ball according to an example 7 of the present invention.
Figure 10:
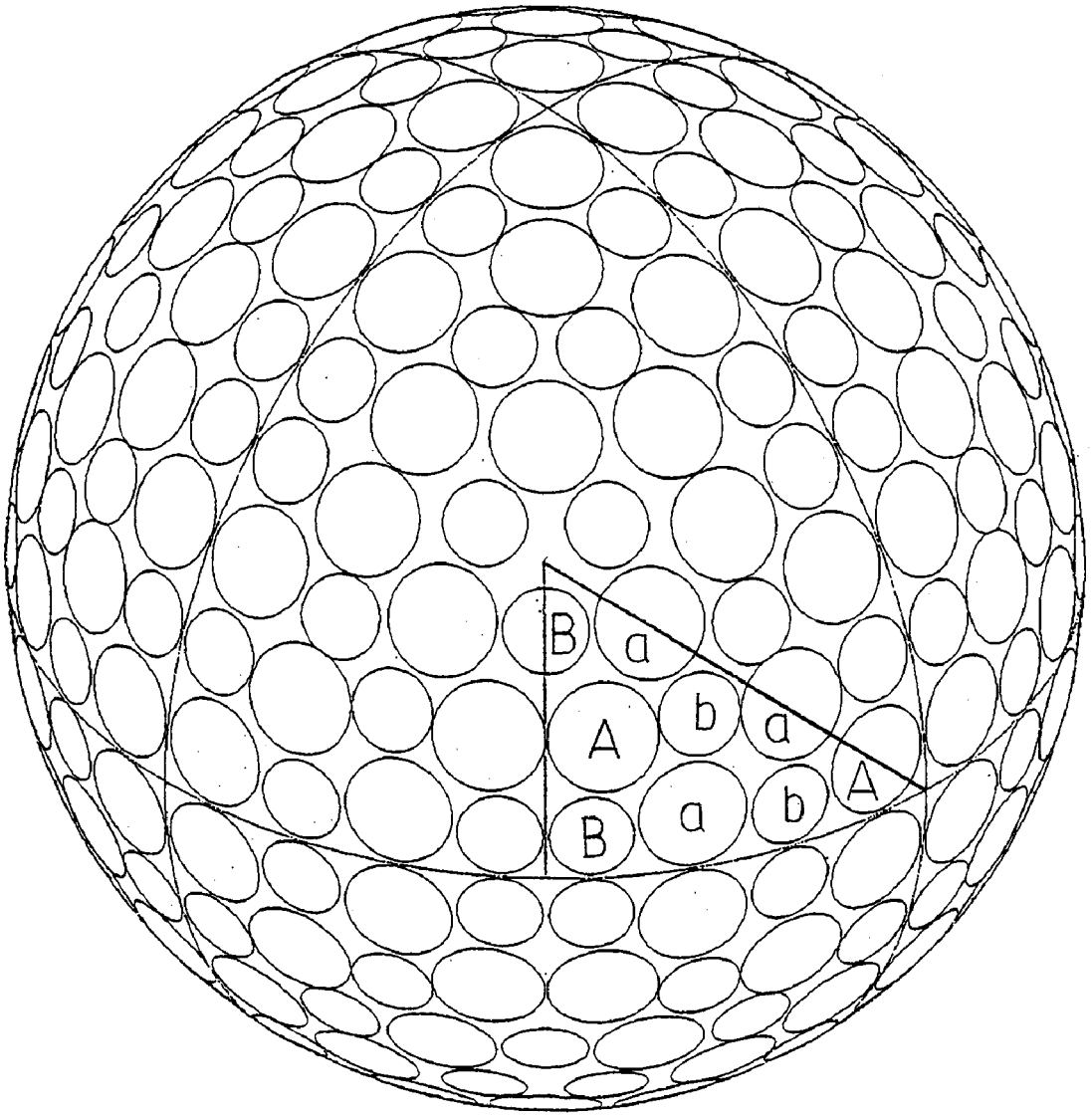
FIG. 10 is a front view showing a golf ball according to an example 8 of the present invention.
Figure 11:
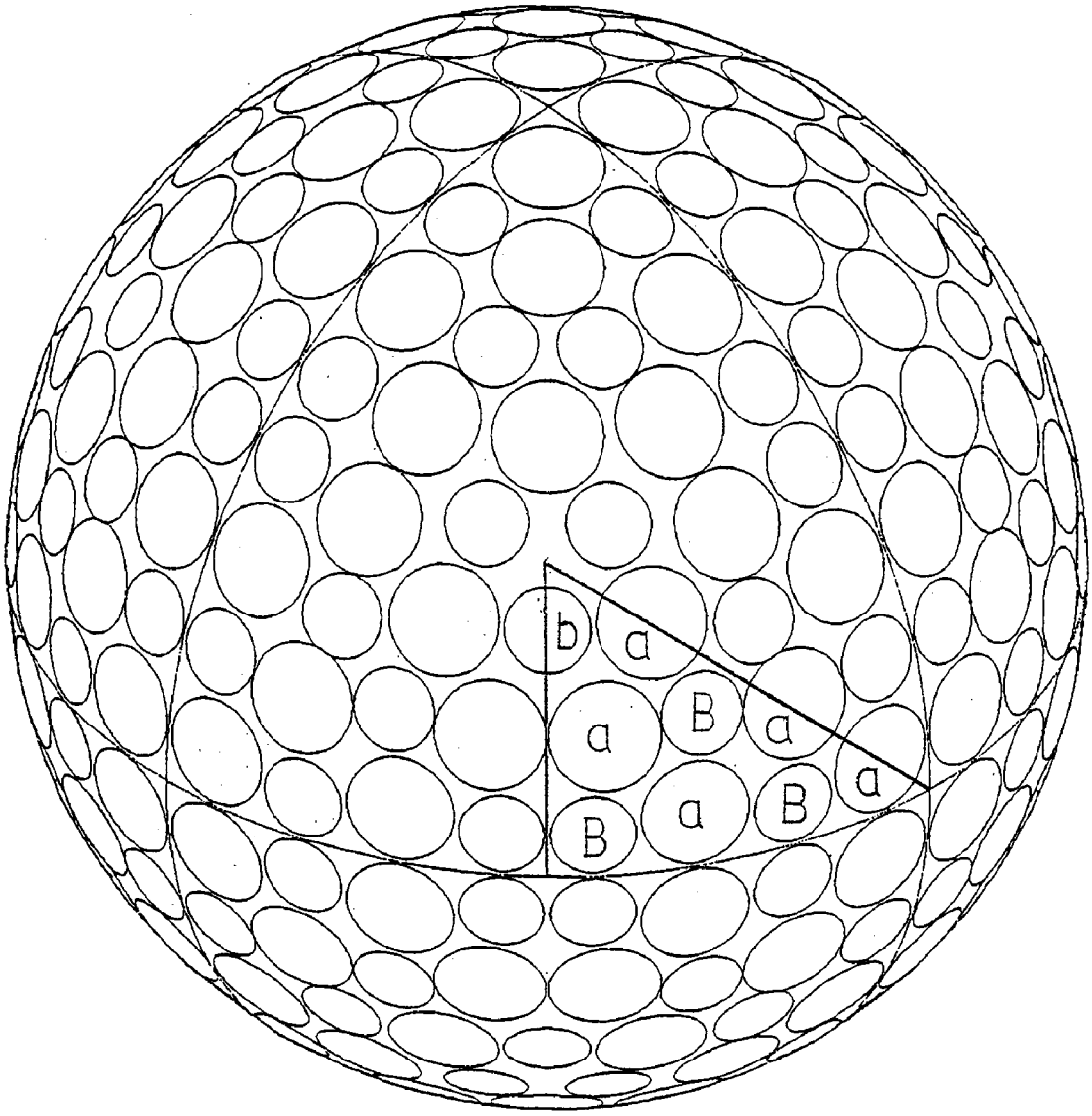
FIG. 11 is a front view showing a golf ball according to an example 9 of the present invention.

| | Result of flight distance test | | | | | | | | |
|---|---|---|---|---|---|---|---|---|---|
| | Example 1 | Example 2 | Example 3 | Example 4 | Example 5 | Example 6 | Example 7 | Example 8 | Example 9 |
| Dimple pattern | Fig. 1 | Fig. 4 | Fig. 5 | Fig. 6 | Fig. 7 | Fig. 8 | Fig. 9 | Fig. 10 | Fig. 11 |
| Total number of dimples | 336 | 336 | 336 | 336 | 336 | 336 | 336 | 336 | 336 |
| Surface area occupation ratio (%) | 77.0 | 77.0 | 77.0 | 77.0 | 77.0 | 77.0 | 77.0 | 77.0 | 77.0 |
| Total volume ($mm^3$) | 532.2 | 532.1 | 532.2 | 532.2 | 531.8 | 531.9 | 531.9 | 532.0 | 531.9 |
| Ratio of dimple having (V1 < V2) (%) | 14.3 | 21.4 | 28.6 | 35.7 | 42.9 | 42.9 | 57.1 | 57.1 | 57.1 |
| Ratio of dimple having (V1 < V2) and diameter of 3.8 mm or more (%) | 7.1 | 14.3 | 14.3 | 21.4 | 42.9 | 21.4 | 7.1 | 28.6 | 50.0 |
| Carry (m) | 231.1 | 232.2 | 233.3 | 234.5 | 232.9 | 234.8 | 231.8 | 234.2 | 233.6 |
| Total (m) | 248.1 | 249.0 | 250.4 | 250.5 | 249.8 | 251.8 | 249.6 | 251.5 | 249.3 |

TABLE 4

Figure 12:
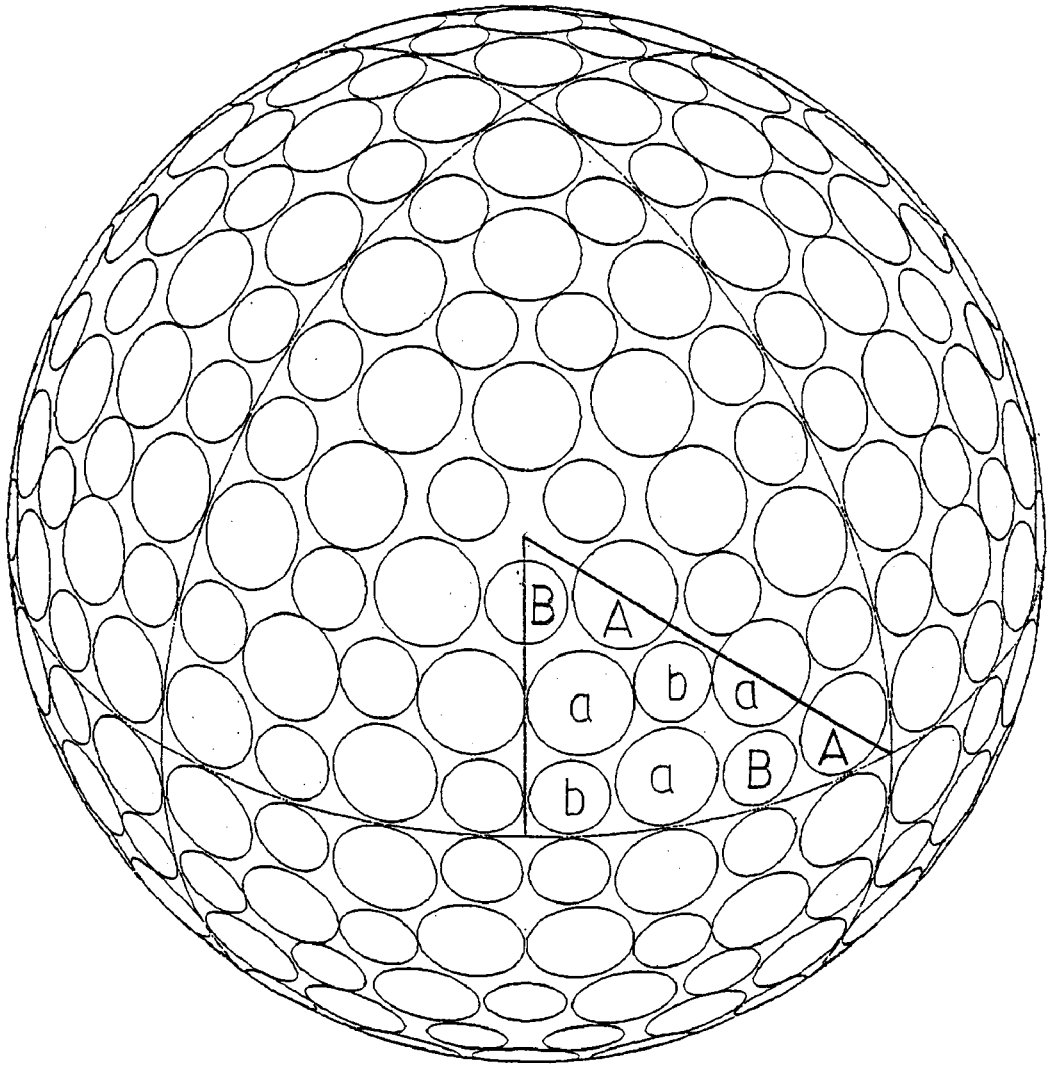
FIG. 12 is a front view showing a golf ball according to an example 10 of the present invention.
Figure 13:
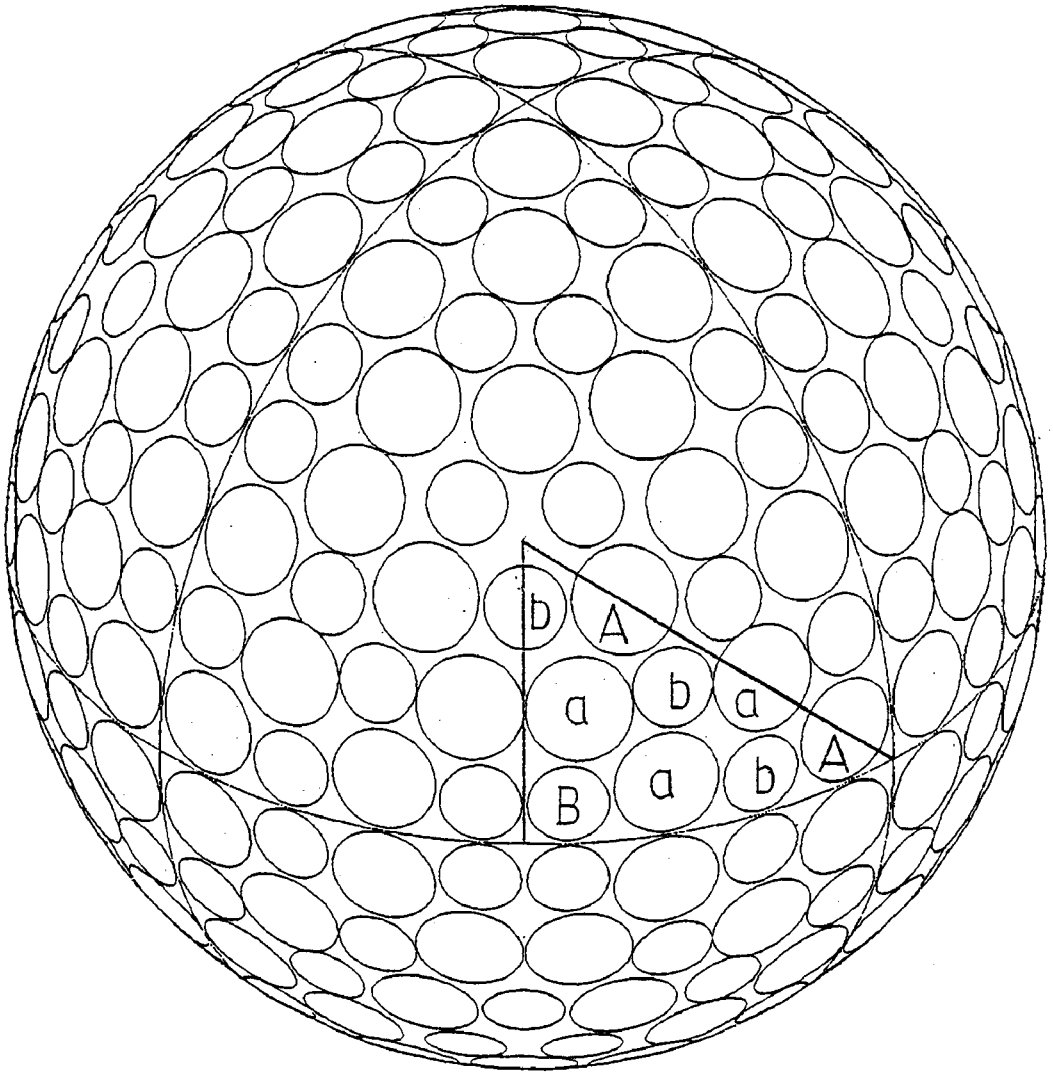
FIG. 13 is a front view showing a golf ball according to an example 11 of the present invention.
Figure 14:
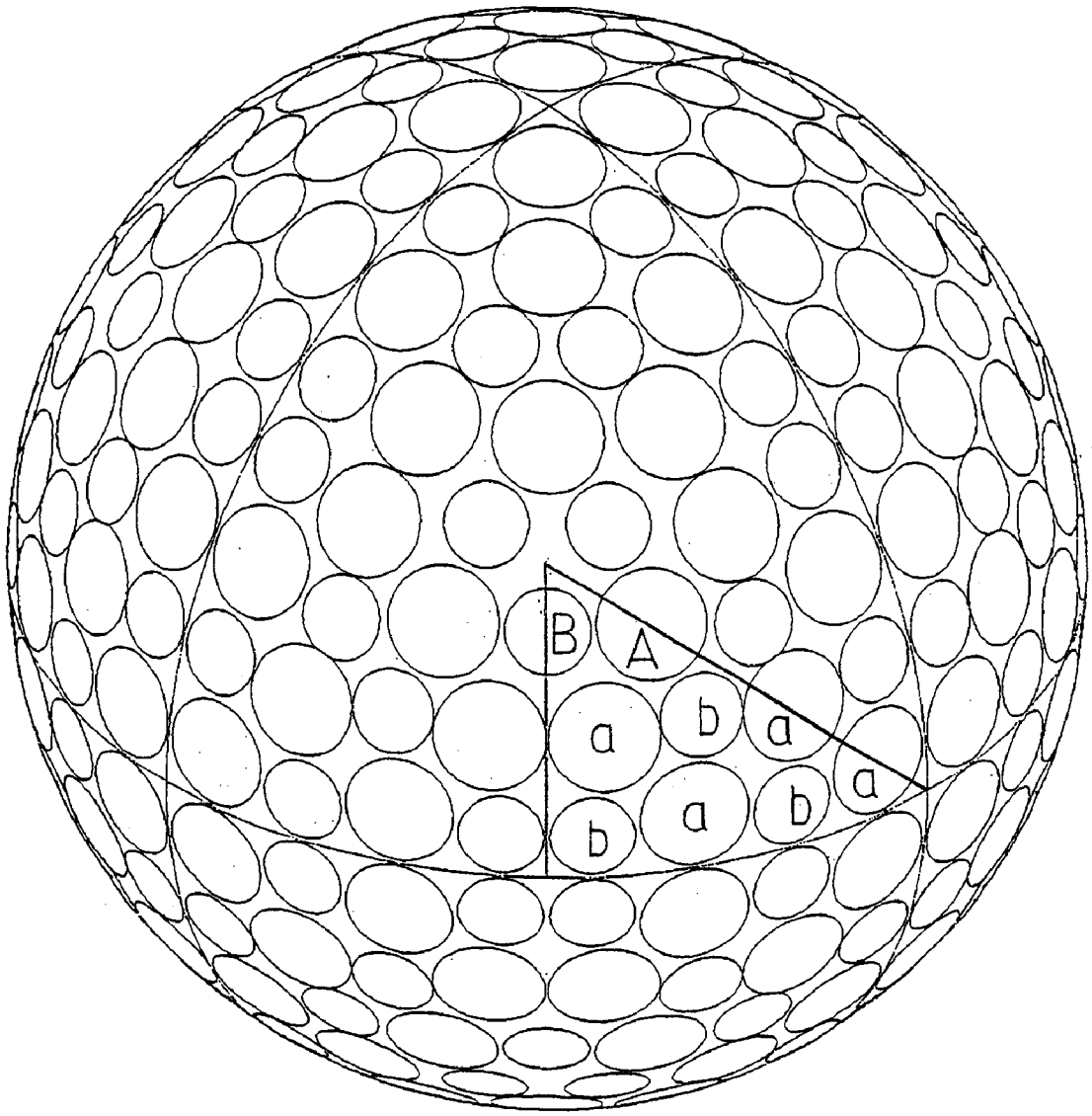
FIG. 14 is a front view showing a golf ball according to an example 12 of the present invention.
Figure 15:
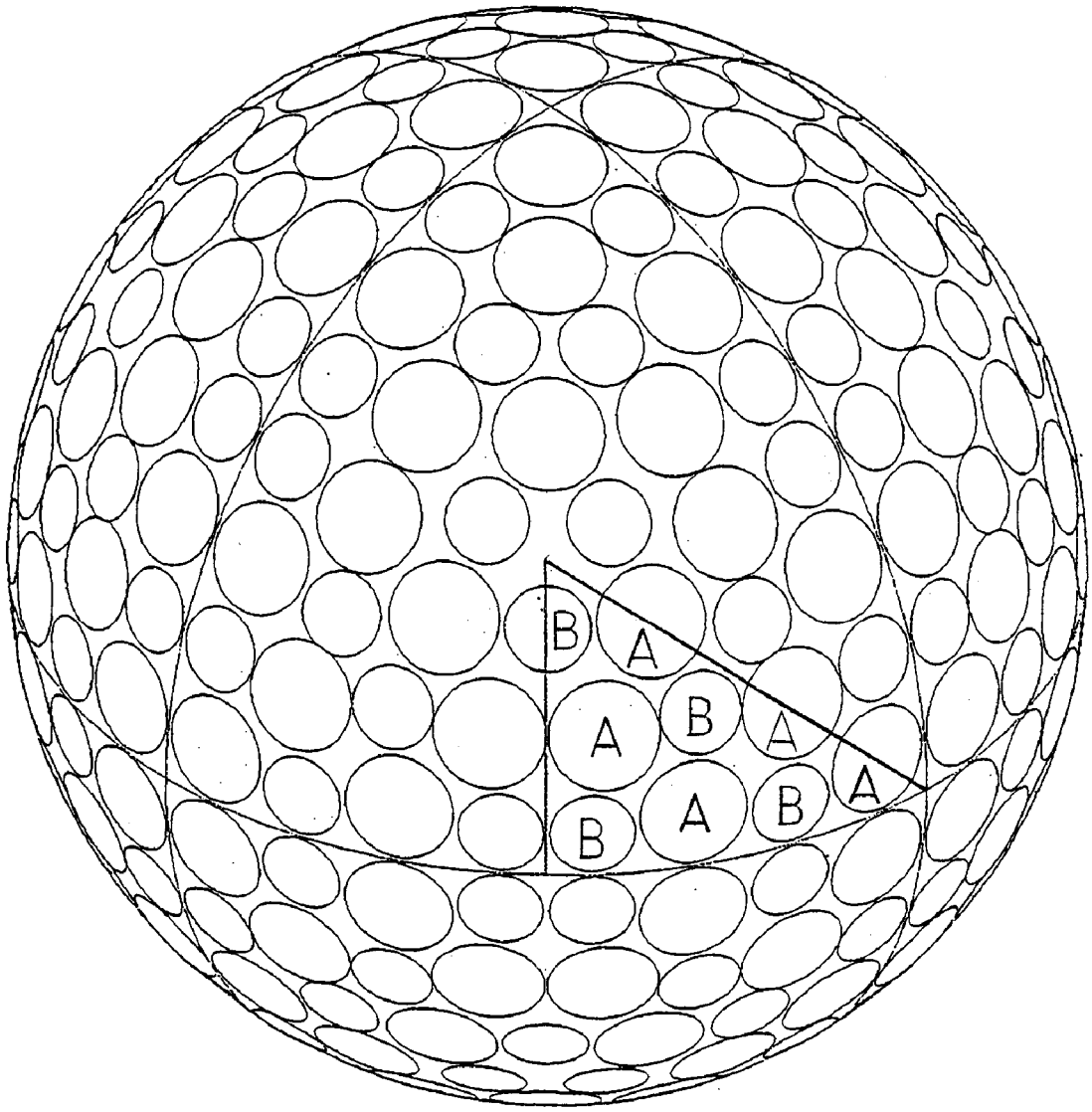
FIG. 15 is a front view showing a golf ball according to a comparative example 1 of the present invention.
Figure 16:
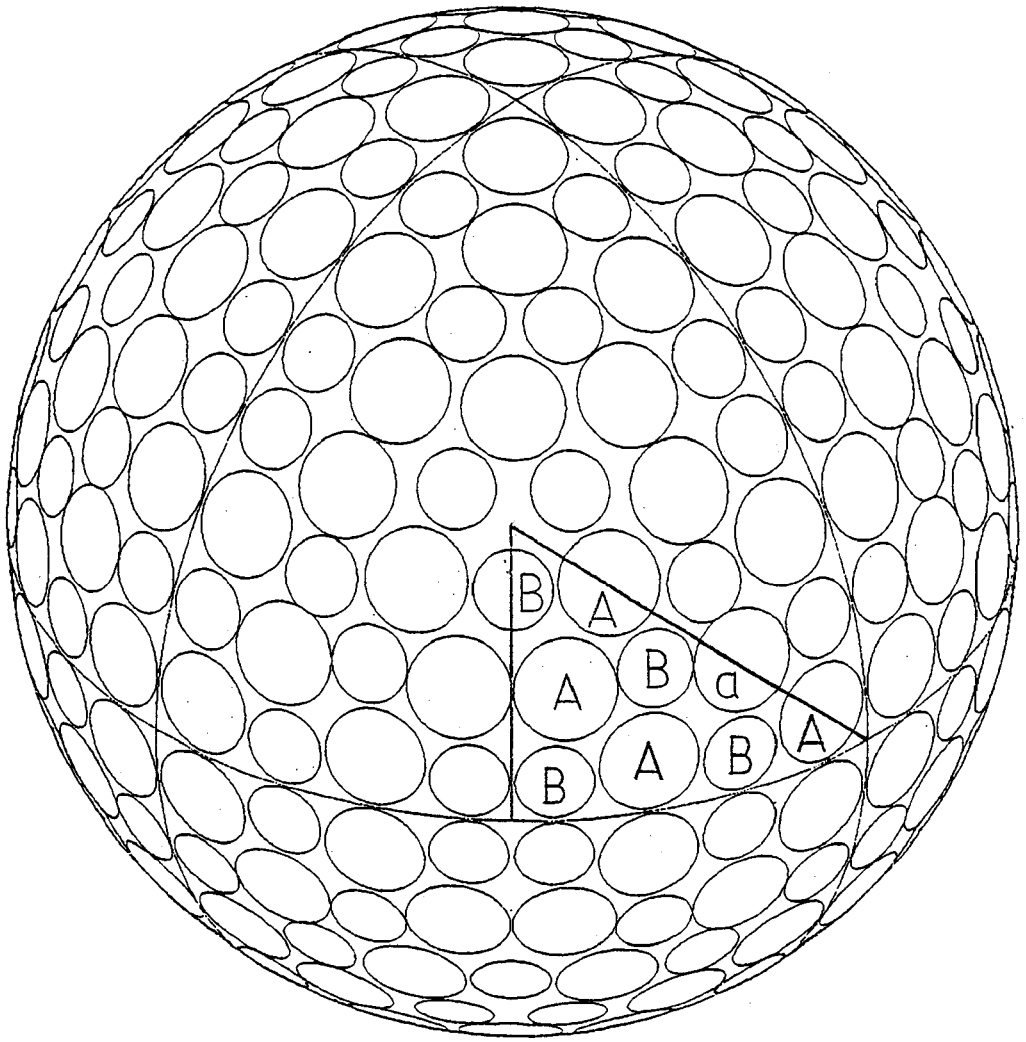
FIG. 16 is a front view showing a golf ball according to a comparative example 2.
Figure 17:
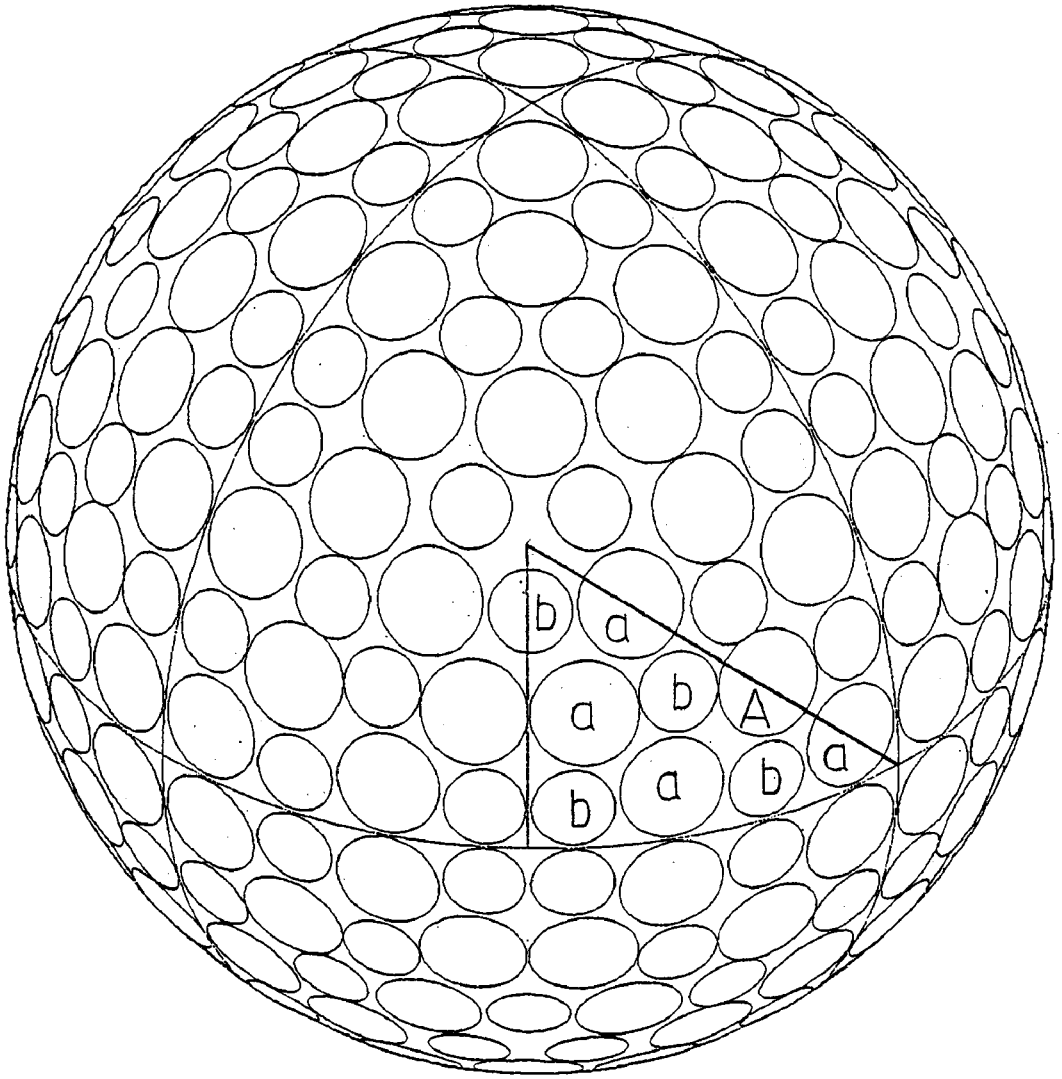
FIG. 17 is a front view showing a golf ball according to a comparative example 3 of the present invention.

| | Result of flight distance test | | | | | | | |
|---|---|---|---|---|---|---|---|---|
| | Example 10 | Example 11 | Example 12 | Com. Example 1 | Com. Example 2 | Com. Example 3 | Com. Example 4 | Com. Example 5 |
| Dimple pattern | Fig. 12 | Fig. 13 | Fig. 14 | Fig. 15 | Fig. 16 | Fig. 17 | Fig. 8 | Fig. 8 |
| Total number of dimples | 336 | 336 | 336 | 336 | 336 | 336 | 336 | 336 |
| Surface area occupation ratio (%) | 77.0 | 77.0 | 77.0 | 77.0 | 77.0 | 77.0 | 77.0 | 77.0 |
| Total volume ($mm^3$) | 531.9 | 531.9 | 532.2 | 531.7 | 531.7 | 532.1 | 467.7 | 630.1 |
| Ratio of dimple having (V1 < V2) (%) | 64.3 | 71.4 | 85.7 | 0.0 | 7.1 | 92.9 | 42.9 | 42.9 |
| Ratio of dimple having (V1 < V2) and diameter of 3.8 mm or more (%) | 35.7 | 35.7 | 42.9 | 0.0 | 7.1 | 42.9 | 21.4 | 21.4 |
| Carry (m) | 233.9 | 232.3 | 232.0 | 228.4 | 229.2 | 227.7 | 224.2 | 222.2 |
| Total (m) | 250.4 | 249.4 | 248.6 | 245.1 | 246.0 | 244.8 | 237.5 | 244.4 |

As shown in the Tables 3 and 4, the golf balls according to the examples have greater flight distances than those of the comparative examples. By a result of the evaluation, the advantage of the present invention is apparent.

The above description is only illustrative and can be variously changed without departing from the scope of the present invention.

What is claimed is:

1. A golf ball having a large number of dimples on a surface, wherein when a volume of a region surrounded by a plane including edges of the dimples and surfaces of the dimples is represented by V1 and a volume of a region surrounded by the plane including the edges of the dimples and a virtual spherical surface is represented by V2, a ratio of the number of the dimples having the smaller volume V1 than the volume V2 to the total number of the dimples is 10% to 90%, and a sum of the dimple volumes obtained by adding the volumes V1 and the volumes V2 is 480 $mm^3$ to 620 $mm^3$.

2. The golf ball according to claim 1, wherein a ratio (V2/V1) of the volume V2 to the volume V1 in the dimple having the smaller volume V1 than the volume V2 is 1.01 or more.

3. The golf ball according to claim 1, wherein a ratio of the number of dimples having the smaller V1 than the volume V2 and a diameter of 3.8 mm or more to the total number of the dimples is 10% to 45%.

4. The golf ball according to claim 1, wherein there are provided plural kinds of dimples having diameters different from each other and the smaller volume V1 than the volume V2.

5. The golf ball according to claim 1, wherein a surface area occupation ratio to be a ratio of a total area of the dimples occupying a surface area of the virtual spherical surface is 60% to 90%.

* * * * *